US005617809A

United States Patent [19]

Arango

[11] Patent Number: 5,617,809

[45] Date of Patent: Apr. 8, 1997

[54] DIVING TOW BOARD

[76] Inventor: Concepcion J. Arango, Bidasoa 16, 28002 Madrid, Spain

[21] Appl. No.: 574,625

[22] Filed: Dec. 19, 1995

[51] Int. Cl.[6] ..... B63B 35/79

[52] U.S. Cl. ..... 114/315; 114/244; 114/253; 441/65

[58] Field of Search ..... 114/274, 244, 114/242, 253, 315, 245; 441/65, 72, 73; 405/186

[56] References Cited

U.S. PATENT DOCUMENTS

| | | | |
|---|---|---|---|
| 4,207,829 | 6/1980 | Meister et al. | 114/315 |
| 5,263,430 | 11/1993 | Monfort | 114/244 |
| 5,482,485 | 1/1996 | Ball | 114/253 |

*Primary Examiner*—Edwin L. Swinehart

[57] ABSTRACT

Diving tow board of the kind composed of a noticeably lengthened body which is manufactured in light and unsinkable material, of rigid constitution, manufactured in polyester reinforced with fibreglass, polypropylene, polystyrene, wood, which is constructed from a body formed by four planes in such a way that at their junctions they form three rounded edges and among which, the central one, which divides the body in two symmetrical parts, continues forwards in a prow-like protuberance and turns back forming a gentle curve until it meets the frontal edges of the planes which emerge from it, and which at its junction with the lateral planes forms other edges which are preferably rounded, from which these last-mentioned lateral planes adopt a curved plantar form in their frontal part which diminishes and turns back until it meets the rear part of the board.

1 Claim, 1 Drawing Sheet

DIVING TOW BOARD

PURPOSE OF THE INVENTION

The present specification refers to a diving tow board, whose obvious purpose is to provide the keen sportsman with the possibility of carrying out diving activities using the board as an element that facilitates and determines immersion to a greater or lesser extent, being dragged by a boat.

1. Field of the Invention

The application of this invention is within the industry devoted to the manufacture of auxiliary material for aquatic sports.

2. Description of the Invention

The diving tow board proposed by the invention, constitutes in itself an obvious novelty within the area where it is to be incorporated, since it represents the achievement of an auxiliary element for diving, which when towed by a boat and suitably positioned by the user, it is possible to carry out diving operations in a simplified way, and move easily under the water.

More specifically, the diving tow board which is the subject of the invention is composed of a single block, with the option of two symmetrical blocks joined by hinges at their three edges, which has a noticeably lengthened plantar configuration, which when seen in elevation resembles a broken line with three angles. The second or central angle, pointing downwards in the form of a valley divides the board into two symmetrical parts, which in turn divide into two planes which form at their junction an angle or crest, preferably in a rounded way. That is to say, these three angles divide the board into four planes, the two central ones in a V shape and each of the end planes together with one of the central planes likewise form an inverted V.

The two lateral planes may optionally end in a curve, more pronounced at the prow than at the stern and have oval ergonomic apertures at their rear to serve as handholds for both the user's hands, when the board is towed as was mentioned above, by a boat.

Likewise the existing rounded angle between the two central planes, where it meets the edges of the prow of these same planes forms a forward-facing protuberance in the fashion of a prow, which is also rounded.

In each of these two central planes there is also an orifice, strategically located in the plane's central zone, where a handle or rope is lodged by means of which towing is effected. And in the central rear part there is another orifice in each of the planes, to lodge a handle or rope so as to act as a resting handhold for the user.

In short, the user grasps the board introducing his hands into the apertures provided for this purpose in the exterior planes and allows him/herself to be pulled along by a boat by means of a rope or handle, which is joined to another handle fixed between two holes located toward the central zone of the lateral planes, and by moving the wrists upwards or downwards, and extending the left or right arm, easily manoeuvres vertically, laterally, or in a circle.

It is not necessary to make this description more extensive because any expert in the subject will understand the scope of the invention, and the advantages it affords. It is to be borne in mind that it can be easily used by children and adults of both sexes.

The materials, form, size and arrangement of the elements will be subject to variation, provided that this does not entail any alteration to the essence of the invention.

The material employed is always to be rigid, light and unsinkable, such as polyester reinforced with fibreglass, polypropylene, polystyrene, wood, etc.

DESCRIPTION OF THE DRAWINGS

To complement the description which is being given and in order to promote a better understanding of the features of the invention, a sheet of plans is included which, in an illustrative but not a limitative way, represents the following.

DESCRIPTION OF A PREFERRED EMBODIMENT

In the light of these figures it may be observed how the diving tow board is constituted optionally from a single block. It presents a plantar configuration which is noticeably lengthened and an elevated configuration of 4 broken planes, thus forming 3 edges, two of which point upwards, B1 and B2, and a central one pointing downwards, C, which divides the board into two symmetrical parts, and in whose frontal part there exists a protuberance, 8, pointing forwards which smoothly meets the frontal edges of the planes which form it, 6. In the lateral planes, the frontal part of the edge forms a curve which is pronounced at its end, and which diminishes when it meets the edge of the rear part.

Figure 1:
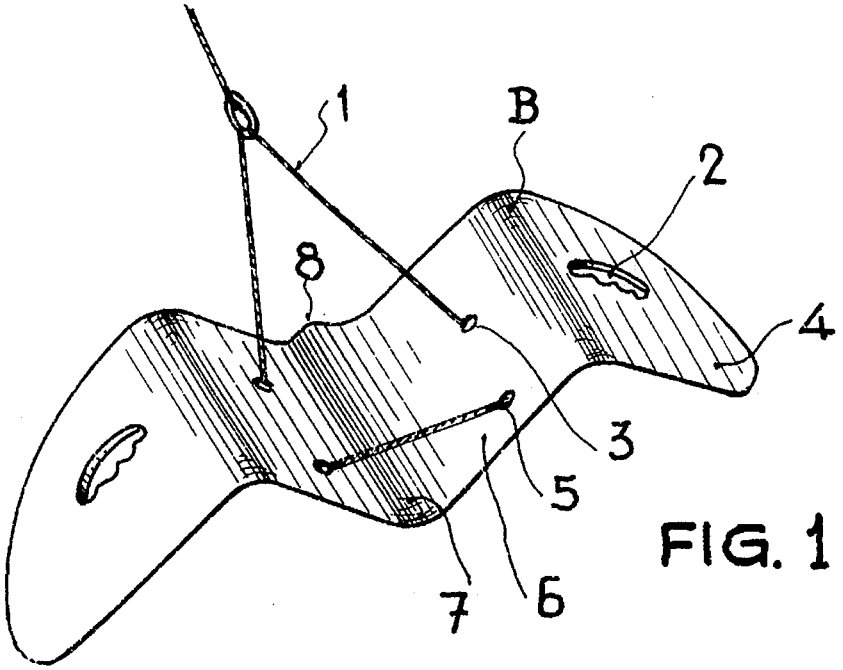
FIG. 1. Shows a perspective view of the subject of the invention relating to a diving tow board, with the ropes or handles necessary for the purpose.
Figure 2:
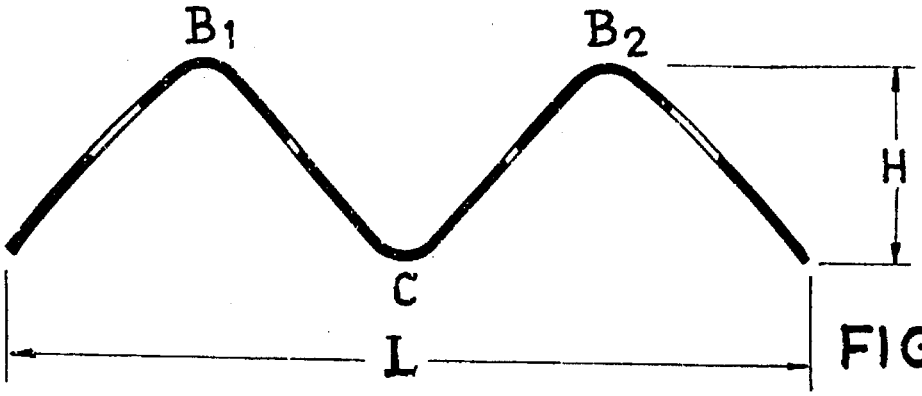
FIG. 2. Shows an elevated section in order to make its angles and silhouette comprehensible.
Figure 3:
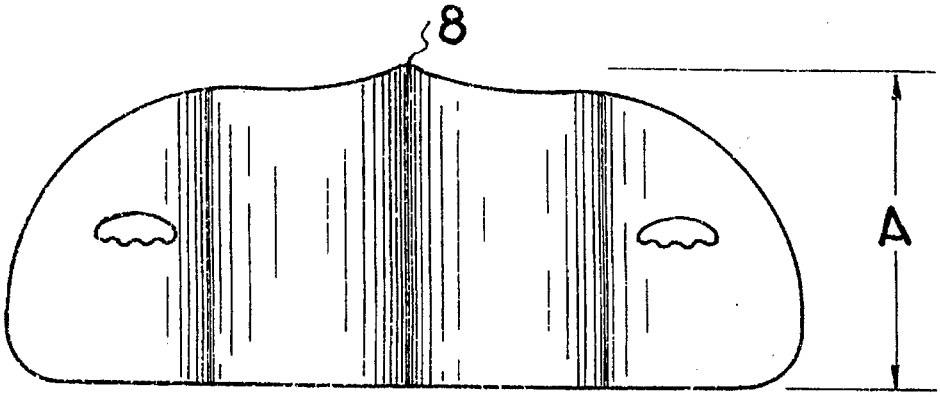
FIG. 3. Shows a view from above of the subject of the invention in order to give an approximate idea of its breadth and the location of its orifices for fixing handles and placing handholds.

In the two central planes there are some orifices, 3, located towards the central zone where from one to another a rope or handle is lodged with a relative amount of play, 1, which is the one designed for coupling to its counterpart in the boat and is responsible for towing. And in its rear part there are two further holes designed to hold another rope or handle, 5, which has the purpose of serving as a resting handhold for the diver, when he/she removes his/her hands from the apertures, 2, located in the lateral planes, constructed ergonomically. It should be pointed out that the approximate width of the board, A in FIG. 3, was considered to be between 15 and 45 cm., its height, H in FIG. 2, between 10 and 25 cm., and its length, L in FIG. 2, between 50 and 80 cm., although these measurements do not signify any limitation in the function of this invention.

The terms in which this description has been stated are to be taken throughout in a wide and not a limiting sense.

I claim:

1. A diving tow board composed of a body manufactured in light and unsinkable material, of rigid constitution, manufactured from at least one of polyester reinforced with fiberglass, polypropylene, polystyrene, and wood, characterized in that the body is formed by two central planes and two lateral planes having a frontal part, the planes each having a frontal edge and meeting at junctions in such a way that at the junctions the planes form three rounded edges, one edge being a central edge which divides the body in two symmetrical parts, continues forwards in a protuberance and turns back forming a curve until it meets the frontal edges of the central planes, and which at the junction of the central planes with the lateral planes forms other edges which are substantially rounded, from which these last-mentioned lateral planes adopt a curved plantar form in their frontal part which diminishes and turns back until it meets a rear part of the board, and in which there are hollows which adapt to a diver's hand in the rear part, there being in the central planes orifices where a tow rope can be fastened; the diving tow board further comprising another hole where a rope may be fastened designed as a resting handhold.

* * * * *